US006769585B2

(12) United States Patent
Santaniello et al.

(10) Patent No.: US 6,769,585 B2
(45) Date of Patent: Aug. 3, 2004

(54) THREE DIMENSIONAL SEMIRIGID PANEL FOR AN ARTICLE CARRIER

(75) Inventors: Steve M. Santaniello, Providence, RI (US); Luke Michas, North Providence, RI (US); Jeremy C. Howard, Little Compton, RI (US)

(73) Assignee: Freerise, Inc., Providence, RI (US)

( * ) Notice: Subject to any disclaimer, the term of this patent is extended or adjusted under 35 U.S.C. 154(b) by 138 days.

(21) Appl. No.: 09/793,837

(22) Filed: Feb. 27, 2001

(65) Prior Publication Data

US 2002/0117527 A1 Aug. 29, 2002

(51) Int. Cl.[7] ..... A45F 3/04

(52) U.S. Cl. ..... 224/629; 190/109; 190/110; 190/111; 190/114; 224/153; 224/630; 224/650; 224/651

(58) Field of Search ..... 224/629, 153, 224/645, 650, 653, 272, 630, 651; 190/107, 109, 110, 111, 114; 220/337, DIG. 10, DIG. 12, DIG. 13; 206/457, 542, 458

(56) References Cited

U.S. PATENT DOCUMENTS

| | | | | | |
|---|---|---|---|---|---|
| 2,742,212 | A | | 4/1956 | Siftar | |
| D256,630 | S | | 9/1980 | Maney | |
| D315,444 | S | * | 3/1991 | Maddocks | D3/66 |
| 5,000,515 | A | | 3/1991 | Deview | |
| 5,255,834 | A | | 10/1993 | Bendersky | |
| 5,294,386 | A | | 3/1994 | Roth et al. | |
| 5,379,911 | A | * | 1/1995 | Goto et al. | 206/457 |
| 5,588,569 | A | * | 12/1996 | Mitomi et al. | 190/110 |
| 5,630,537 | A | * | 5/1997 | Sciacca | 206/561 |
| D386,300 | S | | 11/1997 | Kopel | |
| 5,692,655 | A | | 12/1997 | Fair et al. | |
| 5,713,465 | A | | 2/1998 | Choe | |
| 5,762,243 | A | | 6/1998 | McMaster et al. | |
| 5,765,688 | A | | 6/1998 | Bertram et al. | |
| 5,768,838 | A | | 6/1998 | Georgeau | |
| 5,791,475 | A | * | 8/1998 | Pichardo | 206/457 |
| 5,890,640 | A | | 4/1999 | Thompson | |
| 5,891,372 | A | | 4/1999 | Besset et al. | |
| 5,896,962 | A | | 4/1999 | Smith et al. | |
| 5,988,476 | A | * | 11/1999 | Olerio | 108/107 |
| 6,076,641 | A | * | 6/2000 | Kinzer et al. | 190/18 A |
| 6,145,715 | A | * | 11/2000 | Slonim | 224/148.3 |
| 6,161,739 | A | * | 12/2000 | Bentzen | 224/153 |
| 6,179,102 | B1 | * | 1/2001 | Weber et al. | 190/109 |
| 6,179,186 | B1 | * | 1/2001 | Blanking | 224/153 |
| 6,244,458 | B1 | * | 6/2001 | Frysinger et al. | 220/592.09 |
| 6,530,475 | B1 | * | 3/2003 | Penney | 206/320 |

FOREIGN PATENT DOCUMENTS

| | | |
|---|---|---|
| FR | 2322061 | 2/1977 |
| FR | 2621299 | 10/1987 |

* cited by examiner

*Primary Examiner*—Gregory Vidovich
*Assistant Examiner*—Maerena W. Brevard
(74) *Attorney, Agent, or Firm*—Volpe and Koenig, P.C.

(57) ABSTRACT

The present invention provides a panel for use in an article carrier which has opposed sides which are generally connected by a material which include some form of a closure device. The panel is semirigid with interior and exterior faces. The interior face defines a chamber which opens to the interior of the article carrier and the exterior face defines a three dimensional structure. A method for forming the semirigid panel is also disclosed. The disclosed method provides a means for applying color to the three dimensional structure.

24 Claims, 7 Drawing Sheets

30
10
32
40
38
33
20
35
34
36
38
12
18
39
13
18

THREE DIMENSIONAL SEMIRIGID PANEL FOR AN ARTICLE CARRIER

BACKGROUND

The present invention relates generally to article carriers of the type that are frequently used to transport personal articles for various activities. More particularly, it relates to a back pack or carrier of the type which is frequently used by students and travelers for their immediate personal belongings. Most particularly, it relates to backpack or carrier having a semirigid panel that includes a three dimensional face and defines a minimum interior chamber volume.

SUMMARY OF THE INVENTION

The present invention provides a panel for use in an article carrier which has opposed sides which are generally connected by a material which include some form of a closure device. The panel is semirigid with interior and exterior faces. The interior face defines a chamber which opens to the interior of the article carrier and the exterior face defines a three dimensional structure.

A method for forming the semirigid panel is also disclosed. The disclosed method provides a means for applying color to the three dimensional structure.

BRIEF DESCRIPTION OF THE DRAWING(S)

DETAILED DESCRIPTION OF THE PREFERRED EMBODIMENTS

Figure 1:
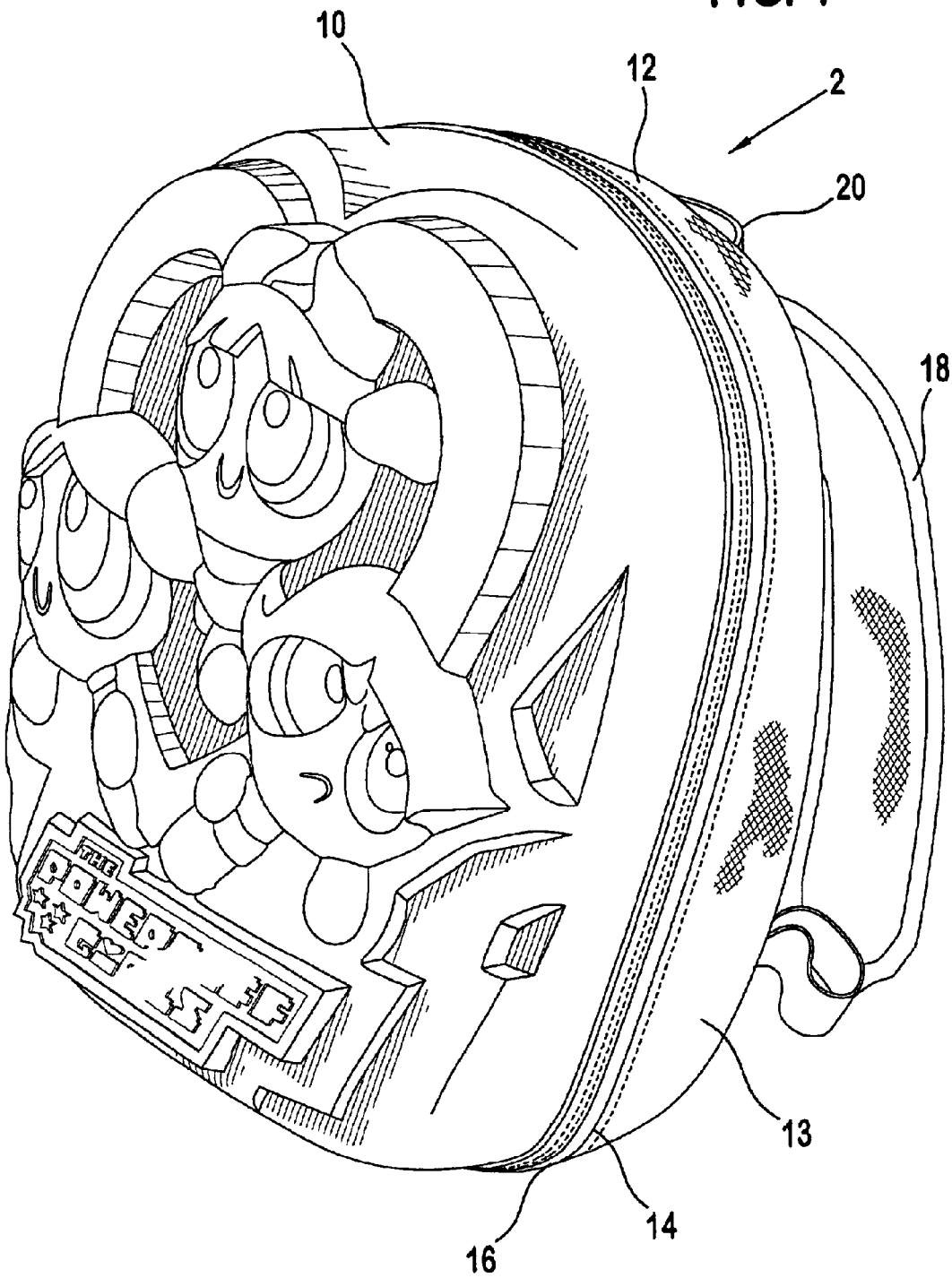
FIG. 1 is prospective view of a carrier having a semirigid panel according to the invention.

With respect to FIG. 1, there is shown a semirigid, three dimensional panel in accordance with the present invention as applied to a personal article carrier 2, which will be recognized as what is commonly called a backpack. The carrier 2 is comprised of a face panel 10, a back panel 12, interconnecting material 14 and a closure device 16. Such article carriers also generally include straps 18 for using the carrier as a backpack or a handle 20 for transporting or handling the carrier by hand. Elements 14 through 20 of the carrier 2 will be common to those skilled in the art and are used in cooperation with the panel of the present invention in a known manner. As can be seen from FIG. 1, the face panel 10 includes a three dimensional relief or structure. The specific three dimensional relief shown in FIG. 1 does not form any part of the present invention and is provided only for the purpose of illustration. Face panel 10 may comprise character reliefs or may include geometric or symbolic figures, such as a sports emblem or sports equipment, without departing from the present invention.

Figure 2:
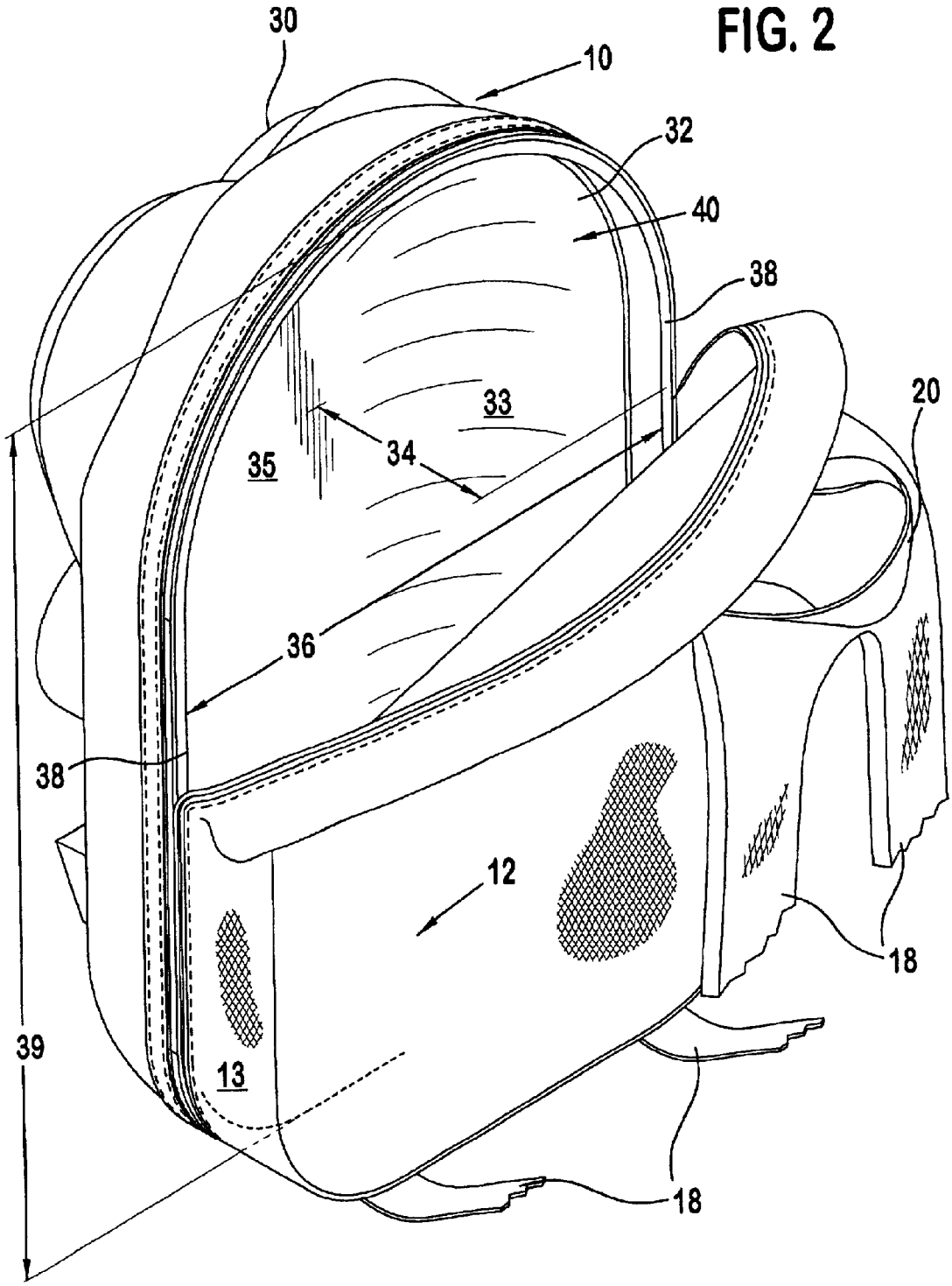
FIG. 2 is a prospective view of the carrier of FIG. 1 in a partially opening configuration to illustrate the interior chamber.

FIG. 2 illustrates the carrier 2 of FIG. 1 with the back panel 18 in a partially opened position. From FIG. 2, it can then be seen that the face panel 10 is concave toward the three dimensional exterior face 30 and away from the circumferential edge 38. Between the three dimensional exterior face 30 and circumferential edge 38, the panel 10 has an interior face 32, with side 33 and back 35 portions interconnected by a curved transition, that defines an interior chamber 40. The chamber 40 has a maximum depth 34 which extends between the circumferential edge 38 and back 35 and a maximum width 36 which extends between opposed lateral portions of the circumferential edge 38. The chamber 40 has a maximum height 39 which extends between opposed, generally centered top and bottom portions of the circumferential edge 38. In a preferred embodiment, the lower edge of the panel 10 is generally flat and the upper edge is generally curved. The opposed lateral edge portions are generally straight with the necessary curvature to provide smooth transitions between and among the portions. Since the preferred closure 16 is generally a zipper, sharp edges are avoided as they frequently lead to difficulty in use of a zipping closure device. In a similar manner, the transitions between the back portion 35 of interior face 32 and side portions 33 of interior face 32 are generally curved. Because of the semirigid configuration of the panel 10, the chamber 40 defines a minimum interior volume for the carrier 2.

As illustrated, the preferred embodiment utilizes a back panel 12 which is generally a textile material. Although the textile material is generally of a heavy denier and somewhat stiff, it is not rigid and can be compressed. As illustrated, the back textile panel 12 has a depth defined by the side wall 13. However, the back panel 12 may, if desired, be a closure flap which would not add any additional defined volume to the carrier 2. As such, the chamber 40 would define the practical minimum and maximum volumes of the carrier 2. Additionally, the back panel 12 may be a molded panel having the predetermined minimum volume feature of panel 10. Again, these two panels may be interconnected with just a closure means.

Figure 3:
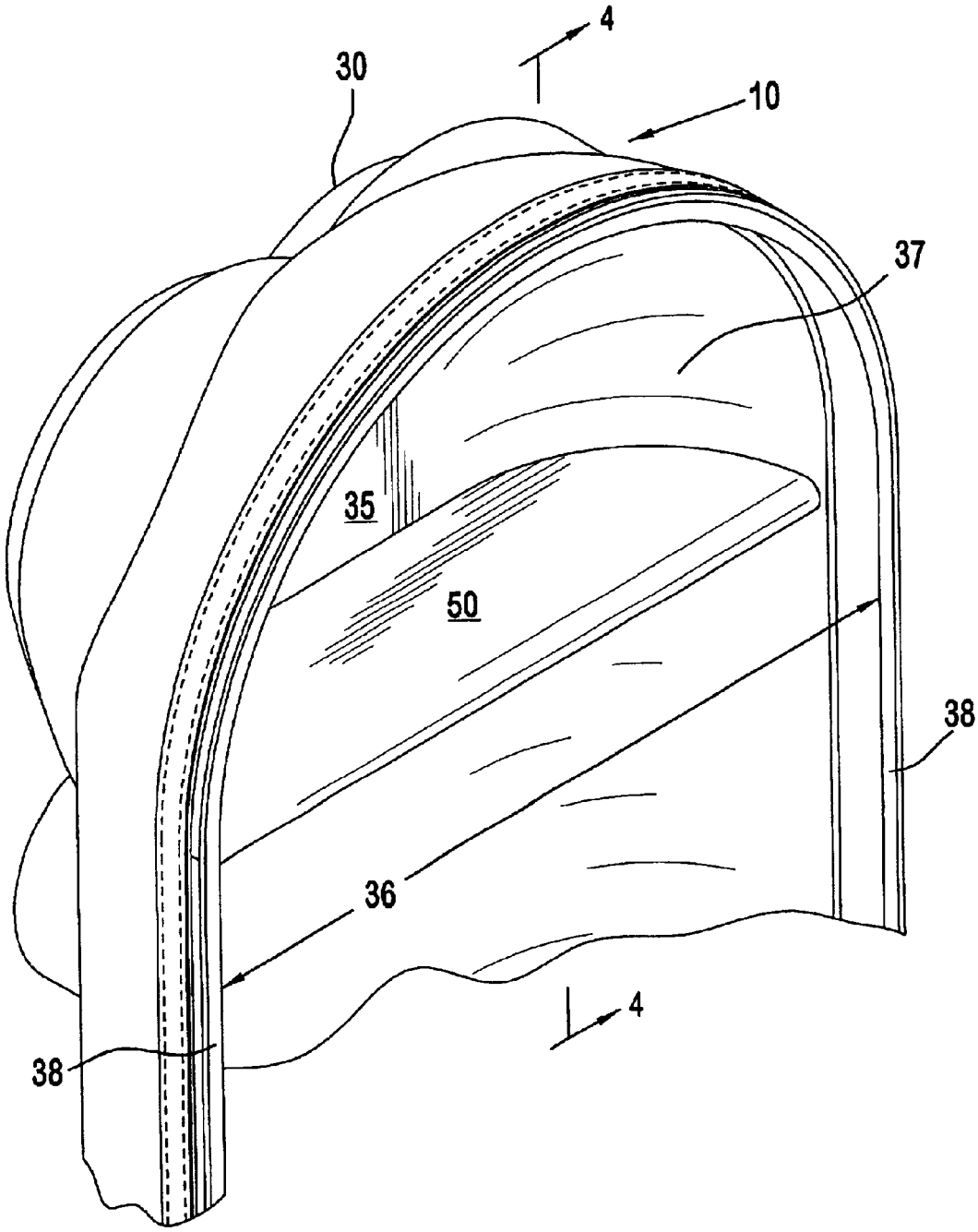
FIG. 3 is a fragmentary view showing an additional feature of the semirigid panel which includes a shelf dividing the interior chamber into subchambers.
Figure 4:
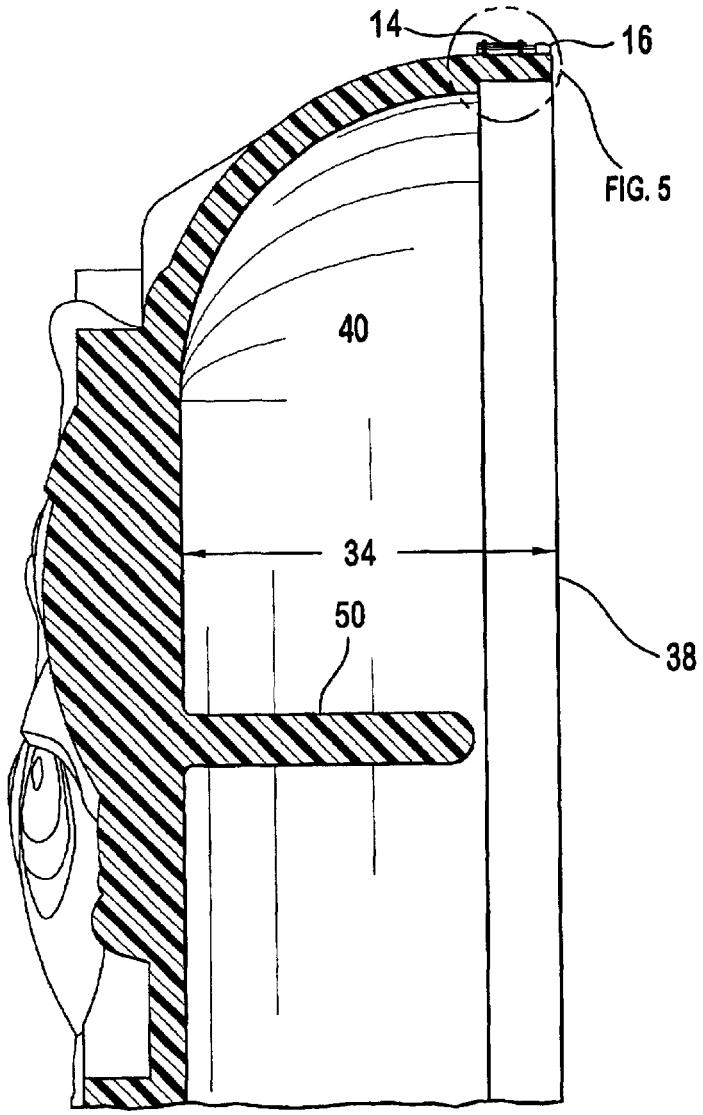
FIG. 4 is a sectional view along the lines 4—4 of FIG. 3.
Figure 5:
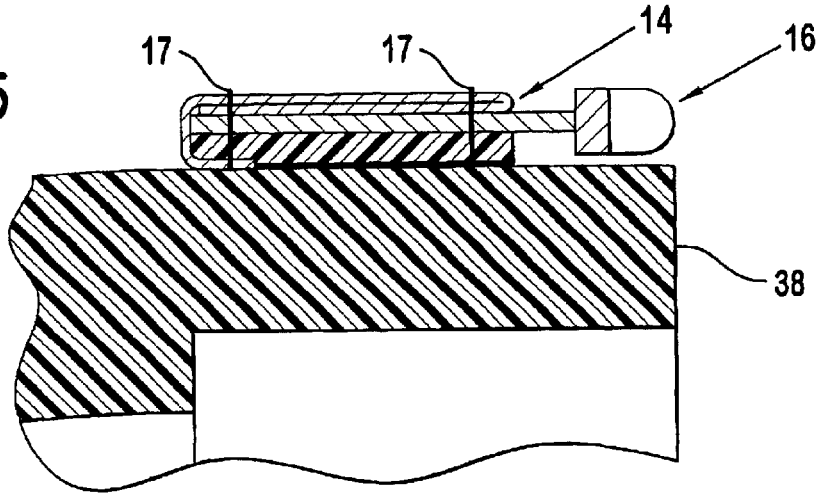
FIG. 5 is an exploded view of the encircled area of FIG. 4.

With reference to FIG. 3, a fragmentary view of the top portion of a face panel 10, there is shown an alternative embodiment of the present invention which includes a fixed divider or shelf 50 which divides the interior chamber 40 into subchambers. As illustrated in FIG. 4, the shelf 50 does not extend to the circumferential edge 38. As also shown in the encircled area of FIG. 4 and the exploded view thereof in FIG. 5, the connecting material 14 and the closure device 16, such as a zipper, Velcro® fastener material or snaps, may be attached about the circumferential edge 38 of face panel 10 through the use of common stitching techniques as illustrated at 17. Alternative attachment techniques, such as adhesive or radio frequency welding, may be used to attach the connecting material and closure to the face panel.

As illustrated in FIGS. 1–5, existing materials, such as leather, vinyl sheeting, PVC or polyurethane film may be used in conjunction with the face panel 10. The face panel 10 is preferably formed by a cast molding technique using a polyurethane foam material. One suitable polyurethane material is a mixture of component batch number 10288-1 (A) and component batch 12088-4(B). The component batch materials A and B are available from Isotec International, Inc. In addition to having some flexibility and excellent tear strength, a face panel produced using these foam components will also have the advantage of being somewhat shock absorbing and insulating. When produced in accordance with the preferred molding technique, they can also be wiped with standard household cleaning materials in order to maintain the desired appearance and surface.

Samples of face panel 10, for testing and durability purposes, were produced in a batch molding technique comprising the following process steps. A two sided mold, the cavity and the core, was prepared so that the cavity included the desired three dimensional exterior face configuration and the core had the desired configuration of the interior chamber 40. It will be recognized by those skilled in the art that the molds are in fact produced so as to be the complement of the actual desired product. In the preferred process, the cavity and core are coated with a suitable release agent and permitted to dry. A barrier coat is then sprayed onto the mold. At this point in the preferred process, the colors desired on the resulting face panel 10 are used as a barrier coating as the colors will be transferred to the casting when it is molded. In the preferred process, the barrier coat or coloring is an acrylic emulsion available from AKZ0 Noble, Inc. as product number 3-E-649. This AKZ0 Noble product is available in almost any color. After application, it is heated to a curing temperature. This may be accomplished in a heating oven or by means of a heat gun. The two part polyurethane foam is weighed, mixed and batched in a volume which is accordance with the desired dimensions and thickness of the face panel 10. In the prototyping process, the foam mixture was hand brushed onto the sides of the mold to ensure that the casting is free of voids and air pockets. In commercial production processes, this technique is automated. Once the desired volume of urethane foam is in the cavity, the core of the mold, which may be similarly treated with a barrier coating or color components, is then placed into the cavity and clamped to bring the cavity and core into the desired registration for the thickness desired in the final face panel 10. It is currently believed that the minimum thickness is an eighth of an inch to a quarter of an inch depending on post molding operations and end use. After approximately fifteen minutes, the chemical curing process is finished and the mold can be opened and the cast part removed. At this point, the color from the beginning of the process is permanently bonded to the cast part and it provides a durable scratch resistant and washable surface.

Figure 7:
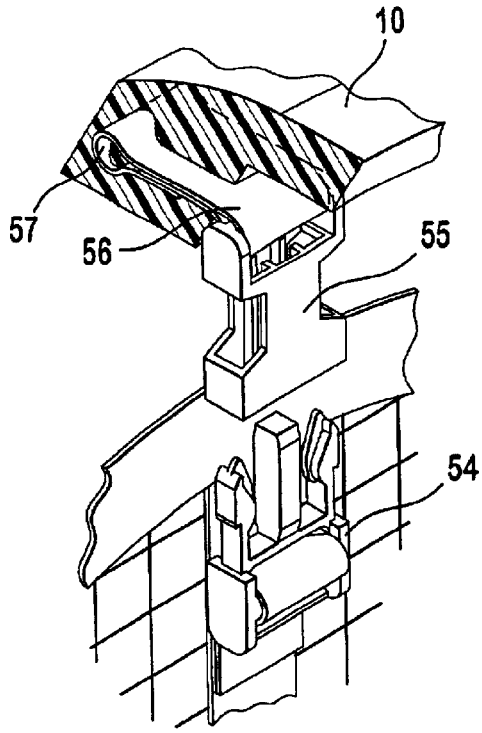
FIG. 7 illustrates one means of attaching the closure device of FIG. 6 to the semirigid panel.
Figure 8:
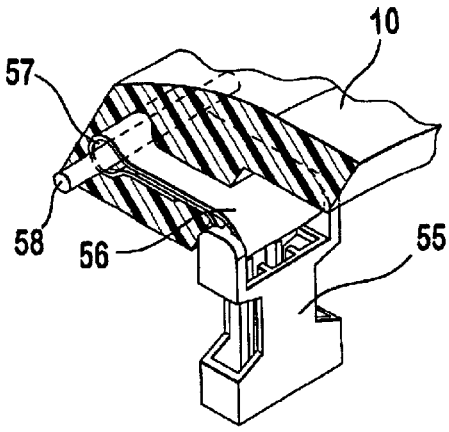
FIG. 8 shows an alternative means for securing the closure to the semirigid panel.

The molding process and the preferred polyurethane foam demonstrated excellent strength characteristics in all planes and permitted the integral molding of a shelf or chamber divider 50 as illustrated in FIG. 4. In addition, this molding technique and material allows the designer to mold in other elements which may further increase the utility of the interior chamber 40. This is illustrated in FIGS. 6–8.

Figure 6:
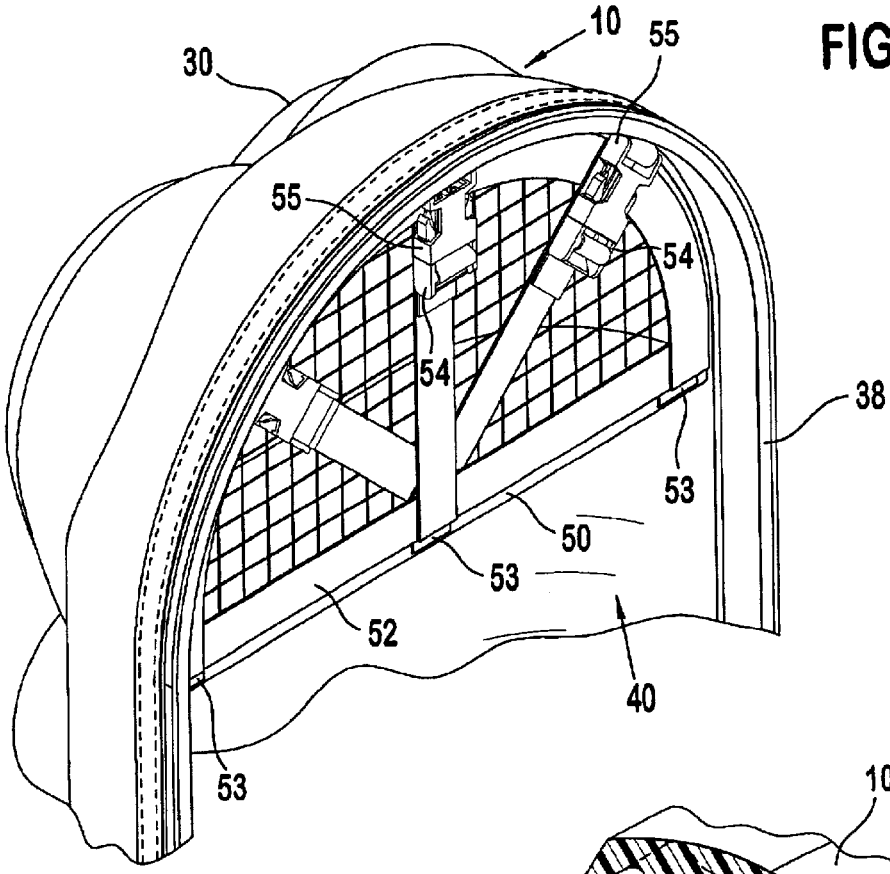
FIG. 6 is a fragmentary view of a carrier showing the addition to the semirigid panel of FIG. 3 of an interior closure device for retaining small articles in the interior chamber.

With reference to FIG. 6, the smaller subchamber defined by the divider or shelf 50 further includes a net like closure 52 which may be permanently or removably assembled to the shelf 50. For permanent assembly, the closure 52 is connected to the shelf 50 via the integrally molded strap members 53 which function as hinges. The closure 52 is connected about the upper portion of the chamber 40 through the commonly known use of plastic buckles which include male portions 54 and female portions 55. As shown in FIGS. 7 and 8, the embedded portion of a component may be embedded in the foam forming panel 10 by providing the connector strap 56 in the mold with an end portion thereof defining a void 57. As material is placed into the mold, the void 57 will be filled by the material defining the face panel 10 and this will secure or fix one end of the strap 56 in the panel 10. The other end of the strap 56 will be free and will retain the female member 55. The alternative construction shown in FIG. 8 fills the void 57, at least partially, with a rod or retaining member 58 which is molded into the material of the face panel 10. With respect to the straps 53, they may be embedded using the techniques shown in FIGS. 7 and 8 or male or female members, such as 54 and 55, may be embedded so that the closure 52 is entirely removable from the face panel 10.

Figure 9:
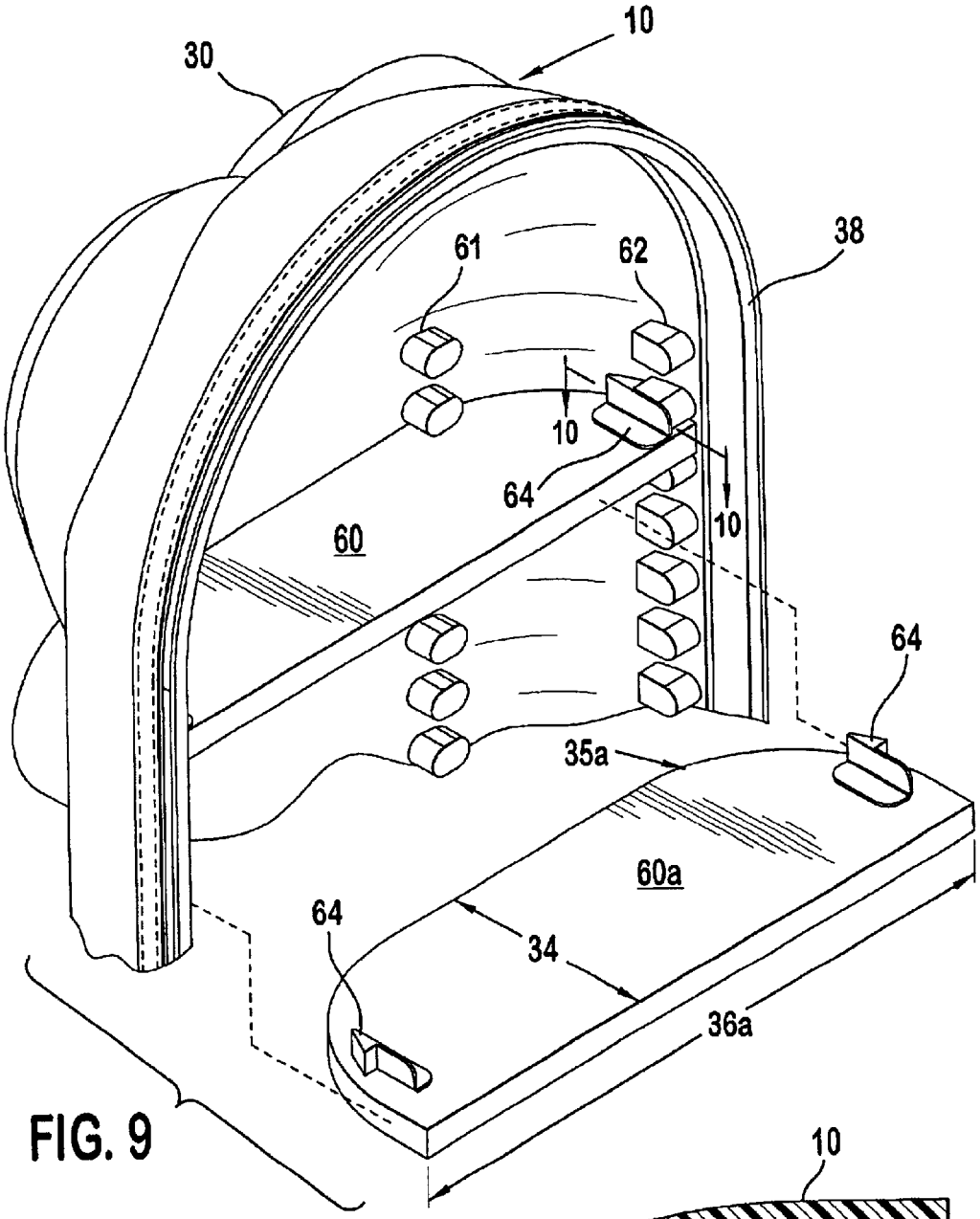
FIG. 9 illustrates an alternative embodiment of the present invention which incorporates a chamber divider or shelf which may be located in various positions of the interior chamber.
Figure 10:
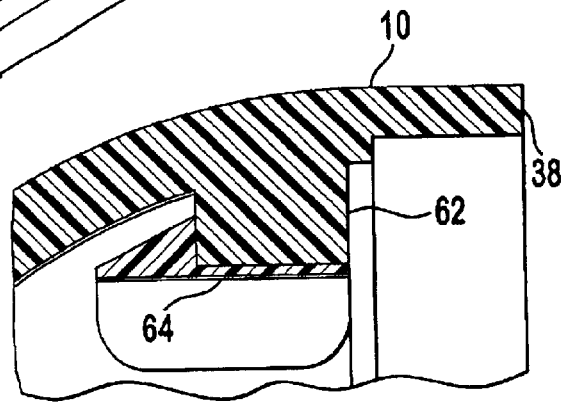
FIG. 10 is a sectional view along the lines 10—10 of FIG. 9 which illustrates one means of retaining the divider or shelf in the chamber.

With reference to FIGS. 9 and 10 there is shown a further alternative embodiment for dividing the interior chamber 40. In this embodiment, the shelf 60 is provided as a removable shelf and shelf rests 61 and 62 are molded into the interior of panel 10 in the manner previously described. Removable shelf 60, preferably, is molded of the same polyurethane foam and includes flexible clips 64 which will lock behind the shelf rest 62 to prevent accidental dislodging of the shelf. Although it may not be necessary, it is presently preferred that the shelf be further supported by the rear shelf rest 61 in addition to the interaction between clip 64 and rest 62. Shelf 60(*a*) shows an alternative embodiment of the shelf which has a width 36(*a*) which is similar to that for the shelf 60. However, shelf 60(*a*) has a greater depth than the shelf 60 and extends to a position which is generally equal to depth 34 or coplanar with the circumferential edge 38. FIG. 10 illustrates integral molding usable with the rests 61 and 62.

Figure 11:
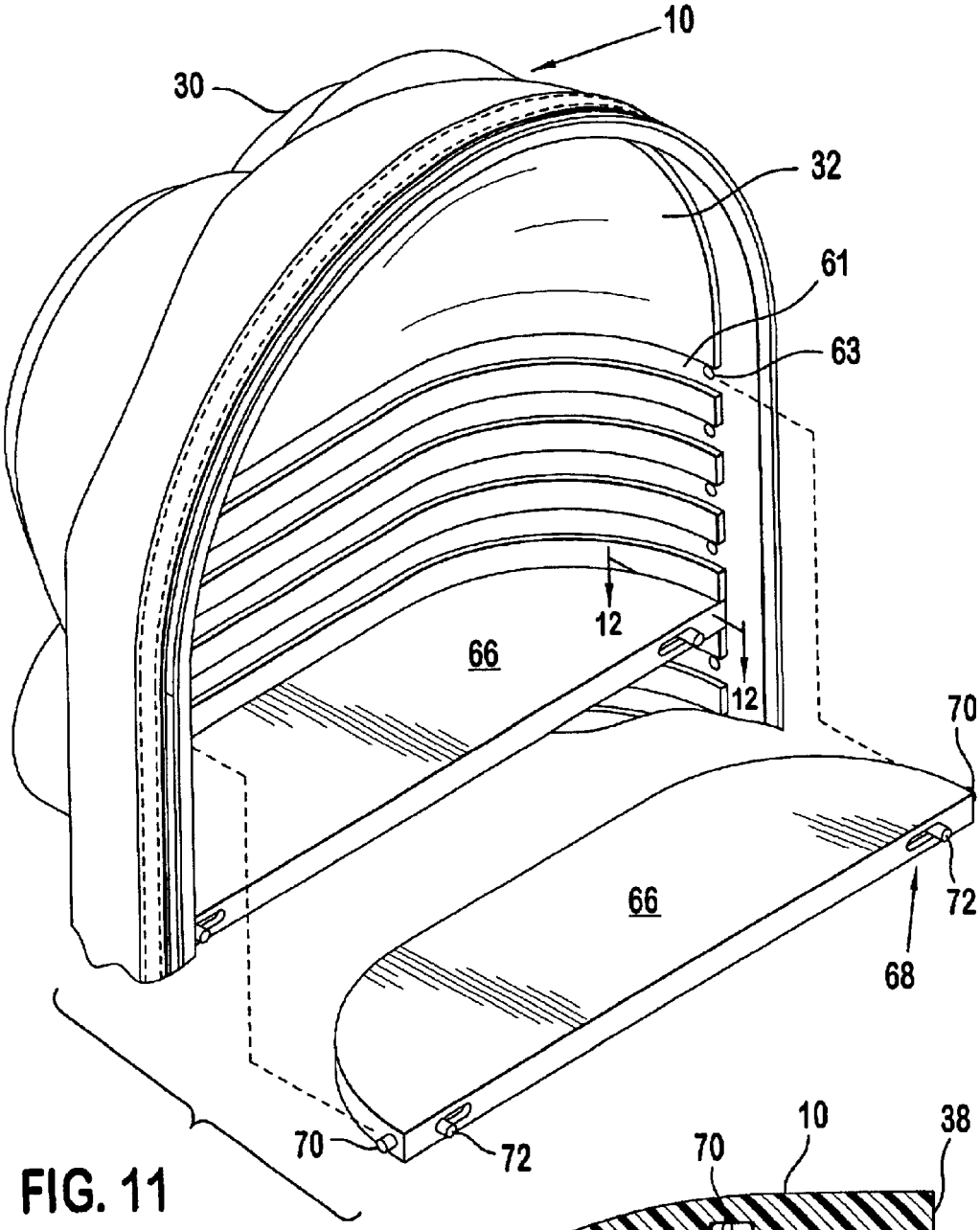
FIG. 11 is a second alternative construction for the semirigid panel with an adjustable divider or shelf within the interior chamber.
Figure 12:
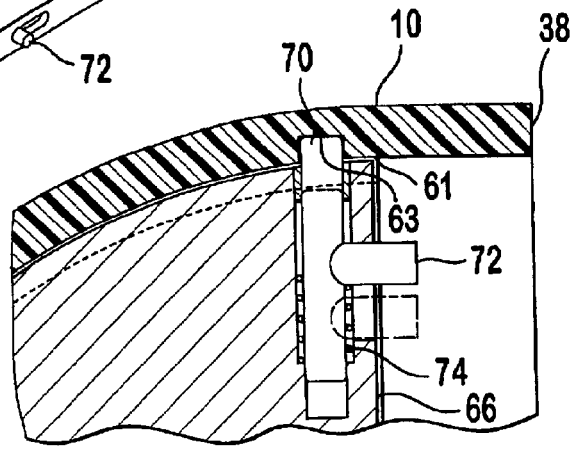
FIG. 12 is a second view along the lines 12—12 of FIG. 11 illustrating a shelf retainer.

FIGS. 11 and 12 show a further alternative embodiment where the shelf rests are comprised of grooves 61 and the means for retaining the shelf 66 are a plurality of recesses 63 in the grooves 61. The shelf 66 includes a spring biased latching mechanism having an outwardly biased pin 70 which complements the recess 63 and outwardly positioned grips 72 for compressing the spring to remove or relocate the shelf 66. As shown in the sectional view of FIG. 12, it is preferred that the spring biased mechanism be molded integral with the shelf to simplify assembly and increase durability.

What is claimed is:

1. An article carrier having:

a three-dimensional semirigid face panel having an interior face, a three dimensional exterior face opposite to the interior face, and a first circumferential edge extending substantially about the face panel;

the interior face defines an interior chamber which provides a minimum interior volume of the article carrier;

a back panel having a second circumferential edge substantially equivalent to and aligned with the first circumferential edge;

a connector, extending between the first and second circumferential edges of the face and back panels, the connector including material portions for connection to the panels and a releasable closure portion extending between the material portions for selectively joining the face and back panels to each other; and at least one shelf rest protruding from the interior face which cooperates with at least one removable shelf extending in a direction orthogonal to a plane defined by the first circumferential edge to divide the interior chamber into two or more sub chambers.

2. The article of claim 1 wherein the three-dimensional semi-rigid face panel consists essentially of a urethane foam.

3. The article carrier of claim 1, wherein the closure portion is a zipper extending substantially around the circumferential edges, and wherein a remaining length of the material portions continues to connect the face and back panels.

4. The article carrier of claim 1, wherein the back panel is semirigid.

5. The article carrier of claim 1, wherein the semirigid face panel is devoid of sharp edges.

6. The article carrier of claim 1, wherein the back panel is devoid of sharp edges.

7. The article carrier of claim 1, wherein the interior chamber is divided into two or more smaller chambers by means of dividers rigidly connected to and formed integral with the interior face.

8. The article carrier of claim 1, wherein the closure portion is a zipper extending substantially around the circumferential edges.

9. The article carrier of claim 1, wherein the closure portion is a zipper extending substantially around the circumferential edges, and wherein a remaining length of the material portions continues to connect the face and back panels.

10. The article carrier of claim 1, wherein the closure portion is a hook and loop fastener extending substantially around the circumferential edges, and the remaining length of material continues to connect the face and back panels.

11. The article carrier of claim 1, further comprising at least one strap, attached to the back panel, for affixing the article carrier to a user's back to facilitate transport of the carrier.

12. The article carrier of claim 1, further comprising at least one handle, attached to the back panel, to facilitate transport of the carrier.

13. An article carrier having:

a three-dimensional semirigid face panel having an interior face, a three dimensional exterior face opposite to the interior face, and a first circumferential edge extending substantially about the face panel;

the interior face defines an interior chamber which provides a minimum interior volume of the article carrier;

a back panel having a second circumferential edge substantially equivalent to and aligned with the first circumferential edge;

a connector, extending between the first and second circumferential edges of the face and back panels, the connector including material portions for connection to the panels and a releasable closure portion extending between the material portions for selectively joining the face and back panels to each other;

at least one shelf rigidly connected to the interior face and extending in a direction substantially orthogonal to a plane defined by the first circumferential edge to define at least two sub chambers;

a flexible closure member, substantially aligned in the plane defined by the first circumferential edge, connected to an end of the at least one shelf substantially opposite the interior face to enclose one or more sub chambers; and wherein the flexible closure member is releasably connected to and extends between the end of the shelf and the first circumferential edge, whereby a sub chamber defined by the shelf, the interior face and the circumferential edge is enclosed by the flexible closure member, the closure member includes a plurality of straps which occupy an area within the plane extending between the end of the shelf and the circumferential edge, a flexible transparent material defined by the area within the plane connected to the straps, and a plurality of buckle portions connected to a plurality of ends of the straps that releasably connect with a plurality of mating buckle portions connected to the circumferential edge.

14. The article of claim 13 wherein the three-dimensional semi-rigid face panel consists essentially of a urethane foam.

15. The article carrier of claim 13, wherein the closure portion is a zipper extending substantially around the circumferential edges, and wherein a remaining length of the material portions continues to connect the face and back panels.

16. The article carrier of claim 13, wherein the back panel is semirigid.

17. The article carrier of claim 13, wherein the semirigid face panel is devoid of sharp edges.

18. The article carrier of claim 13, wherein the back panel is devoid of sharp edges.

19. The article carrier of claim 13, wherein the interior chamber is divided into two or wore smaller chambers by means of dividers rigidly connected to and formed integral with the interior face.

20. The article carrier of claim 13, wherein the closure portion is a zipper extending substantially around the circumferential edges.

21. The article carrier of claim 13, wherein the closure portion is a ripper extending substantially around the circumferential edges, and wherein a remaining length of the material portions continues to connect the face and back panels.

22. The article carrier of claim 13, wherein the closure portion is a hook and loop fastener extending substantially around the circumferential edges, and the remaining length of material continues to connect the face and back panels.

23. The article carrier of claim 13, further comprising at least one strap, attached to the back panel, for affixing the article carrier to a user's back to facilitate transport of the carrier.

24. The article carrier of claim 13, further comprising at least one handle, attached to the back panel, to facilitate transport of the carrier.

* * * * *

UNITED STATES PATENT AND TRADEMARK OFFICE

CERTIFICATE OF CORRECTION

PATENT NO. : 6,769,585 B2
DATED : August 3, 2004
INVENTOR(S) : Santaniello et al.

It is certified that error appears in the above-identified patent and that said Letters Patent is hereby corrected as shown below:

Column 6,
Line 44, after "a", delete "ripper" and insert -- zipper --.

Signed and Sealed this

Twenty-first Day of March, 2006

JON W. DUDAS
*Director of the United States Patent and Trademark Office*